United States Patent [19]

Wiebe

[11] Patent Number: 4,936,226

[45] Date of Patent: Jun. 26, 1990

[54] RAILWAY TRUCK SNUBBER

[75] Inventor: Donald Wiebe, Sewickley, Pa.

[73] Assignee: A. Stucki Company, Pittsburgh, Pa.

[21] Appl. No.: 626,604

[22] Filed: Jul. 6, 1984

Related U.S. Application Data

[63] Continuation of Ser. No. 261,592, May 7, 1981, abandoned, which is a continuation-in-part of Ser. No. 40,756, May 21, 1979, abandoned.

[51] Int. Cl.[5] ..... B61F 5/06; B61F 5/10; B61F 5/12

[52] U.S. Cl. ..... 105/198.3; 105/193; 267/3; 267/225

[58] Field of Search ..... 105/182 R, 193, 197 D, 105/197 DH, 182.1, 197.05, 197.1, 197.2, 198.2–198.5; 188/286, 316, 317, 287; 267/8 R, 8 A, 9 A, 9 B, 3, 225

[56] References Cited

U.S. PATENT DOCUMENTS

| | | | |
|---|---|---|---|
| 2,015,757 | 10/1935 | Moulton | 188/317 |
| 2,040,262 | 5/1936 | Kruckenberg et al. | 105/197 DH X |
| 2,099,240 | 11/1937 | Sproul | 105/193 |
| 2,575,389 | 11/1951 | Lornitzo | 188/286 |
| 3,024,874 | 3/1962 | De Koning et al. | 188/286 |
| 3,626,864 | 12/1971 | Wiebe | 105/197 DH X |
| 3,772,995 | 11/1973 | Wright | 105/197 DH X |
| 3,773,147 | 11/1973 | Wiebe | 105/197 DH X |
| 3,831,529 | 8/1974 | Schwam | 105/197 DH |
| 3,837,292 | 9/1974 | Wiebe | 105/197 DH |
| 3,868,912 | 3/1975 | Wagner et al. | 105/197 DH |
| 3,995,720 | 12/1976 | Wiebe | 105/197 DH |
| 4,004,525 | 1/1977 | Wiebe et al. | 105/197 DH |
| 4,077,496 | 3/1978 | Wiebe | 105/197 DH X |
| 4,162,062 | 7/1979 | Strauss | 105/197 DH X |
| 4,198,911 | 4/1980 | Wiebe | 105/197 DH |
| 4,228,741 | 10/1980 | Bruner | 105/182 R |
| 4,245,563 | 1/1981 | Empson | 105/197 DH |

*Primary Examiner*—Andres Kashnikow
*Attorney, Agent, or Firm*—Carothers & Carothers

[57] ABSTRACT

A hydraulic snubber device and more particularly, a snubber adapted to be interposed in the spring group between a bolster and a side frame member and having a single primary operating cartridge which is selectively usable with a plurality of differing configuration snubber casings or envelopes for a variety of spring group positions; and, further, a snubber device which is operationally positionable within the center of a spring group and is captively retained therein solely by communication of the snubber casing thereof with laterally adjacent springs of such a spring group.

6 Claims, 5 Drawing Sheets

64
36
130
70
68
43
140
33
48
40
50
44
102
30
106
82
78
46
108
76
62
80
32
66
85
OIL LEVEL
88
42
72
74
84
110
104
86
34
56
38
54
58
60
52
37

138
132
138
106
32
112
108
42
136
30
136
138
138
134

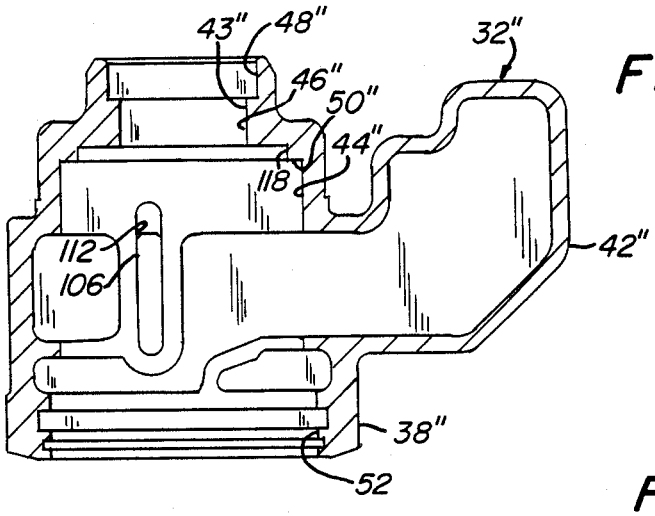
FIG. 10
FIG. 11
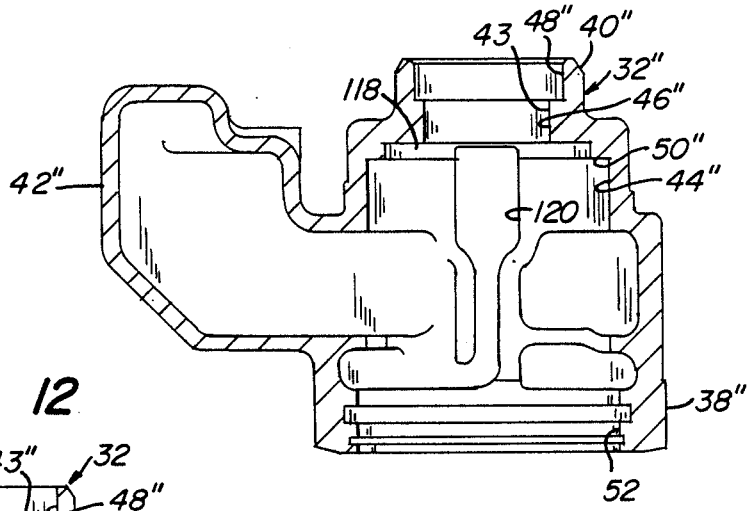
FIG. 12
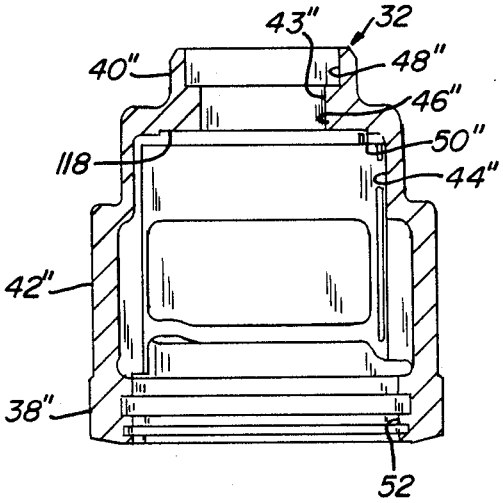

RAILWAY TRUCK SNUBBER

This is a continuation of copending application Ser. No. 261,592, filed May 7, 1984, now abandoned, which was a continuation-in-part of application Ser. No. 040,756 filed May 21, 1979, now abandoned.

As is known, in the normal travel of railway cars over a rail bed, various differences in the vertical profile of the laterally spaced tracks, resulting from rail joints and super-elevation of the outside track on curves, gives rise to a tendency of resonant swaying and bouncing of the car body. In modern cars with heavy load capacity and a relatively high center of gravity, the forces and weight shift of the car resulting from track surface variations becomes so large at times that a variety of effects may develop such as:

1. Complete unloading of the wheels on one side of the truck to the extent of lifting the unloaded wheels off the rail with a high potential of derailment;

2. The imposition of extreme stresses on the car body and truck members; and

3. Cumulative damage and misalignment of track, ties, and road beds through pounding action.

One form of prior art devices which has been developed to alleviate the above-mentioned problems of swaying and bouncing includes hydraulic snubbers which are positionable within the spring groups of railway truck assemblies. On balance, such prior art devices have proved adequate to dampen the forces which give rise to an excessive tendency of lateral rocking or swaying of the car body.

However, in some of such prior art devices, the snubbers generally provide a substantially continuous or linear dampening rate independent of whether or not the railway cars are operating on tangent or superelevated (i.e., six inch superelevation) track. The inability of such snubbers to provide a variable dampening rate has proved to be somewhat unsatisfactory in all instances for experience has shown that a low damping rate is advantageous when the car is operating on tangent track or at equilibrium speed on curved superelevated track and a high damping rate is advantageous when the car is operating on superelevated track at less than equilibrium speed or in instances of severe rocking. When running on tangent track, the tendency of rocking or swaying of the car body is minimal and hence, a relatively soft dampening rate, for example, 25 to 70 kip-seconds per foot for a 100 ton freight car is desirable to insure smooth ride and minimal rebound. On the other hand, in instances of severe rocking or when running on superelevated track at less than equilibrium speed for the particular superelevation and curvature, the tendency of the rocking or swaying of the car body is at a maximum and hence a relatively high dampening rate, for example, 100 to 200 kip-seconds per foot, is desirable to insure maximum energy dissipation.

This recognition of a necessity for a variable dampening rate has been illustrated in U.S. Pat. Nos. 3,626,864 and 4,077,496. The former Patent illustrates an arrangement wherein the means for providing the variable dampening rate are within the casing structure and may only be varied by changing or reworking the casing structure. Furthermore, in this Patent only a continuously variable dampening rate is illustrated which changes uniformly from a low to a high. In the latter Patent, a slotted pin is illustrated which includes highly machined grooves therein to provide the requisite dampening. In this latter instance a new highly machined pin would have to be used if it were desired to vary the dampening rate. Furthermore such a pin-valving arrangement provides a potential interference with the controlled reciprocation of the snubber piston.

The present invention comprises a standard snubber operating assembly which includes a working cylinder. This assembly is received within a snubber casing. The cylinder includes vertically spaced bores therein which communicate with a groove formed in the casing interior wall or the exterior wall of the working cylinder to control the damping rate. Thus, if it is desired to change the parameters of the variable dampening characteristic, it is only necessary, in instances where the groove is formed in the casing, to replace the working cylinder with a cylinder having different bore diameters and/or differently spaced bores. In instances where the groove is formed in the exterior wall of the working cylinder, the replacement cylinders will have differing length groove-bore arrangements to provide the new parameters for the desired variable damping characteristics. There is no necessity to replace or rework the casing or replace a highly machined pin. Furthermore, the arrangement for the present invention does not require additional components which may tend to affect the uniform reciprocation of the snubber piston.

The utilization of a standard or universal snubber operating assembly or cartridge of the present invention provides another significant advantage over spring group snubbers of the type discussed hereinabove. Specifically, the invention herein presents a family of snubbers which all use a single standard operating assembly. Thus by utilizing the structure of the present invention only a single operating cartridge need be manufactured, inventoried and tested regardless of the spring group position or orientation in which the snubber is to be utilized. Only differing configuration snubber casings need be provided for all exterior spring group positions and orientations and, if desired, for the center spring group position.

As was first recognized in U.S. Pat. Nos. 3,837,292 and 3,995,720 a significant operational advantage occurs when the snubber to bolster and side frame relationship is established such that the snubber is operative with an unloaded car and is only truly operational with a loaded car. To achieve this operational relationship the snubber is structured such that the piston operationally communicates with the bolster or side frame only when the car is substantially loaded. In the above Patents and other arrangements, the snubber is retained in operational position with a spring communicating between the snubber casing or piston and the bolster or side frame member from which it is biased away from. The inclusion of such a spring retention can present problems, particularly when the snubber is used in a center position of a spring group (i.e., see U.S. Pat. No. 3,831,529); for example, the retaining spring and/or snubber may have a tendency to lean into and interfere with adjacent load carrying springs thus resulting in operational inefficiencies of the spring group and snubber or damage to the snubber, springs and adjacent truck surfaces.

By means of the present invention which includes a center position snubber having a casing which is cooperable with all of the adjacent springs for the captive retention thereof, the tendency of snubber cocking is lessened and, further, the necessity for a snubber retaining spring in certain instances is no longer a requisite and the hereinabove-mentioned problems associated with retaining springs are overcome or, in the least, greatly alleviated.

The invention herein additionally recognizes that in snubbers of the type discussed herein, an excessive heat build-up occurs adjacent the opening of the snubber casing through which the piston reciprocates. This heat build-up may result in overheating of the rod seal with potential deleterious operating effects and seal problems and would be particularly severe at the center spring group snubber location because of the lock of adequate air flow. To overcome this problem the invention utilizes a casing heat dissipation means adjacent the seal location.

Accordingly, it is one object of this invention to provide a system of snubbers which include an improved means for a variable dampening rate, the operating parameters of which may be readily changed.

Another object of this invention is to provide a family of snubbers wherein a variety of snubber casings may be utilized with a single standard operating assembly or cartridge.

A still further object of this invention is to provide a snubber which may be positioned within the center location of a spring group and captively retained thereat without the necessity of a retaining spring.

Yet another object of this invention is to provide a snubber having heat dissipation means adjacent the area of piston reciprocation to and from the snubber casing.

These and other objects and advantages of the present invention will become more readily apparent upon a reading of the following description and drawings in which.

Figure 4:
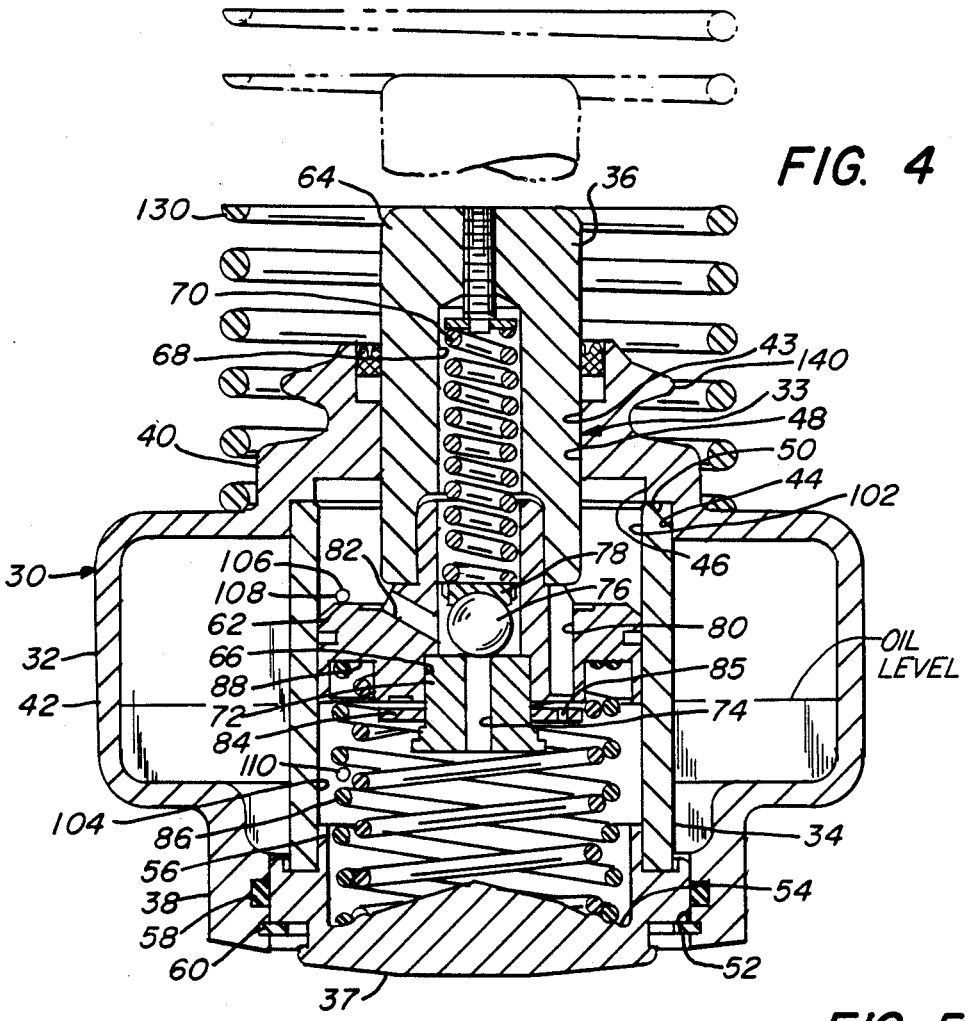
FIG. 4 is a cross-sectional view of a snubber constructed in accordance with the principles of the present invention and of a configuration to be received within the center of a spring group.
Figure 6:
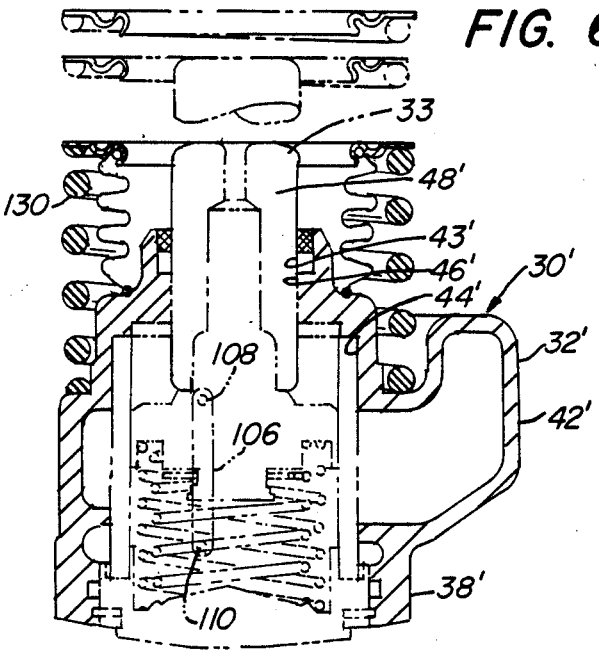
FIG. 6 is a cross-sectional view, partially schematic, of a snubber constructed in accordance with the principles of the present invention, which utilizes a standard operating cartridge therein, such as is illustrated in detail in FIG. 4, and which incorporates a casing configuration of a type to be utilized in an exterior spring group location.
Figure 8:
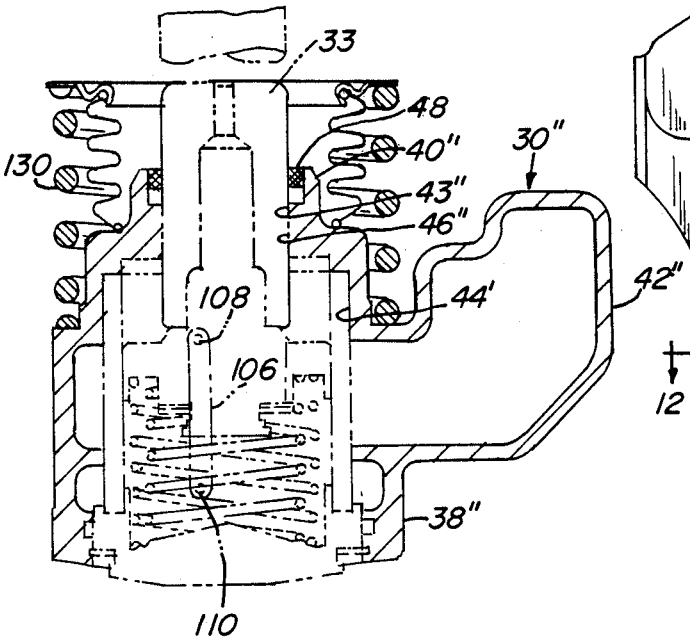
FIG. 8 is a cross-sectional view similar to FIG. 6 but which illustrates another configuration of a casing of a type to be utilized in an exterior spring group location.
Figure 9:
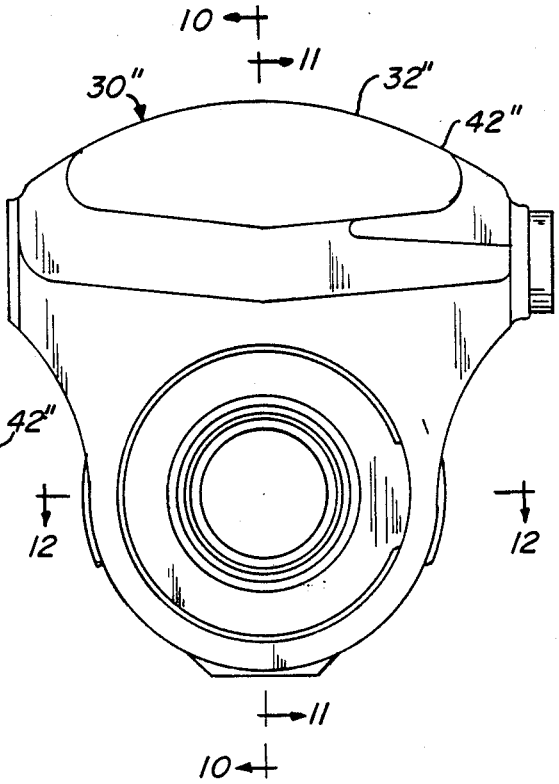
FIG. 9 is a plan view of the snubber illustrated in FIG. 8.
Figure 13:
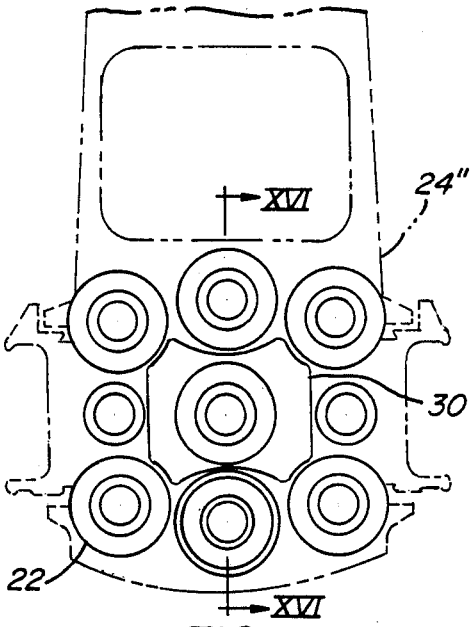
Figure 15:
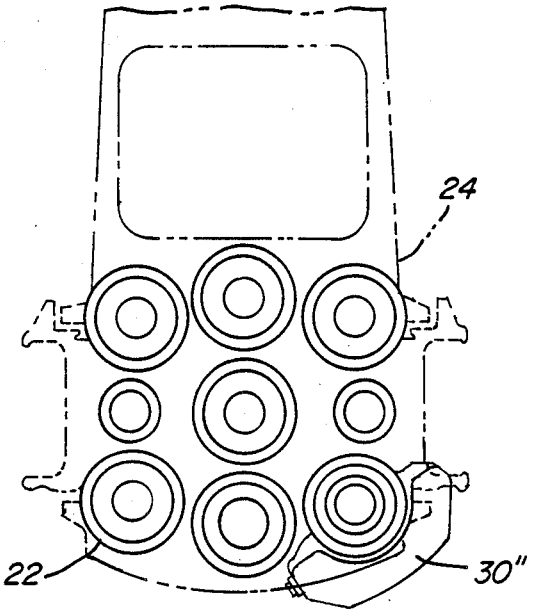
Figure 14:
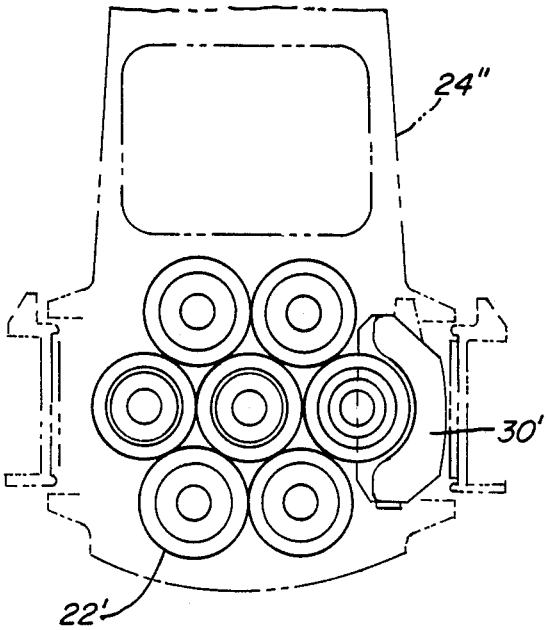

FIGS. 10, 11, and 12 are cross-sectional views, taken substantially along lines 10—10, 11—11 and 12—12 of FIG. 9, respectively and which illustrate the interior of a snubber casing;

FIG. 13 is a schematic plan view of a railway freight car truck spring group with the snubber of FIG. 4 positioned therewithin but without a vertical snubber retaining spring;

FIG. 14 is a schematic plan view of a railway freight car truck spring group with the snubber of FIG. 6 positioned therewithin;

FIG. 15 is a schematic plan view of a railway car truck spring group with the snubber of FIG. 8 positioned therewithin;

FIG. 16 is a schematic partially sectioned side elevation taken generally on line XVI—XVI of FIG. 13.

Figure 1:
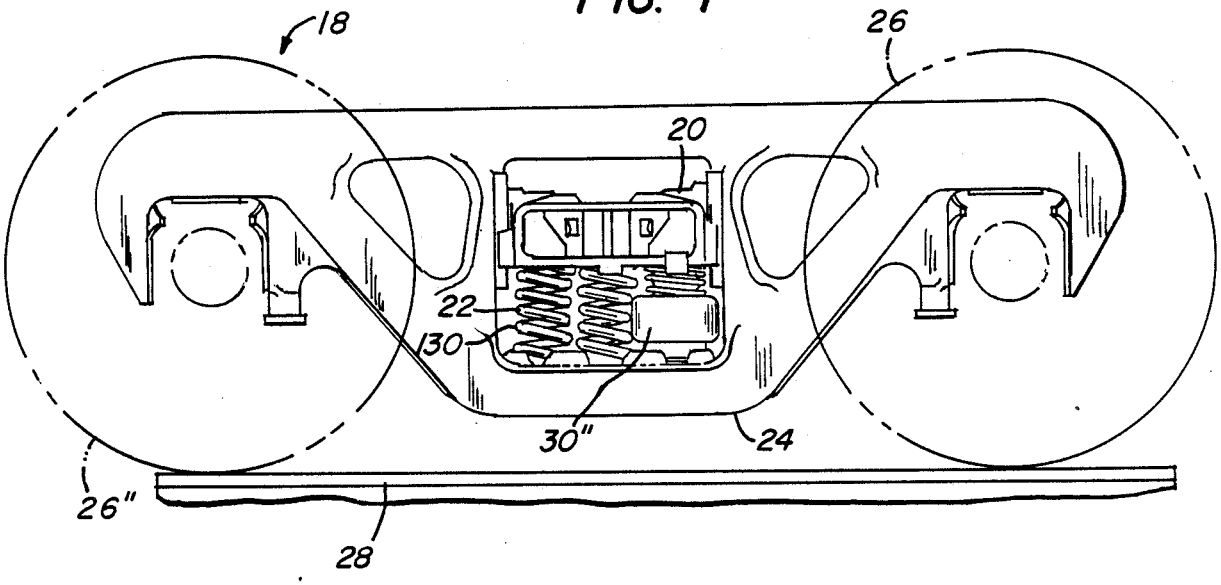
FIG. 1 is a fragmentary side elevational view of a freight car truck incorporating a snubber of this invention.
Figure 5:
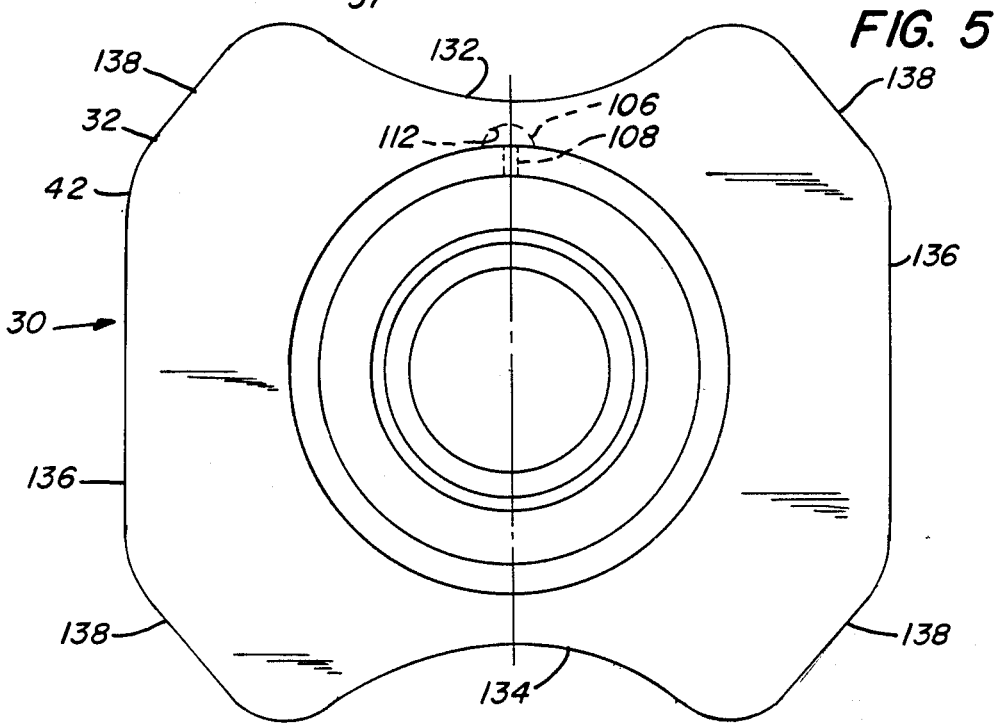
FIG. 5 is a plan view of the snubber illustrated in FIG. 4.
Figure 7:
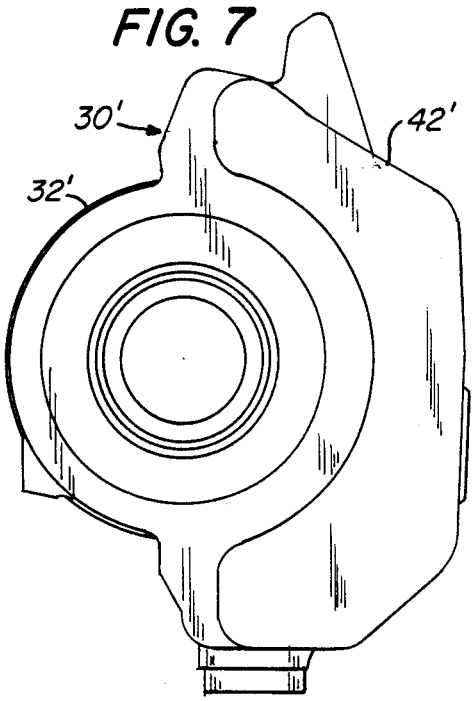
FIG. 7 is a plan view of the snubber illustrated in FIG. 6.

FIG. 1 illustrates a fragmentary portion of a four-wheel freight truck, generally illustrated at 18, which comprises a center plate and suitable side bearings (not shown) cooperating with a bolster 20 to support the car body (not shown); spring groups 22 mounted in side frame 24 (only one being shown) to support the bolster 20; and suitably journaled wheels 26 supporting each side frame 24 and resting on tracks 28. A snubber 30″ of the present invention best illustrated in FIGS. 8 and 9 with the casing interior thereof best shown in detail in FIGS. 10, 11 and 12, is shown as being disposed in the spring group 22. Snubber 30 (FIGS. 4 and 5) and snubber 30′ (FIGS. 6 and 7) are illustrations of other snubbers constructed in accordance with the principles of the present invention.

Inasmuch as the invention herein is primarily directed to snubbers 30, 30′ and 30″ and the balance of the elements set forth hereinabove are well known in the art, further description of such elements will not be set forth hereinafter except when necessary to describe snubber 30, 30′ and 30″.

The snubber 30 comprises: a hollow body member or casing 32; and a standard or universal snubber operating cartridge 33 which is operationally received within casing 32. Operating cartridge 33 comprises: a hollow cylindrical sleeve 34 which is received within casing 32; a piston assembly 36 axially reciprocable within sleeve 34; and a closure and bearing member 37 which provides a seating means for the lower end of sleeve 34 and which is releasably carried by casing 32 adjacent the lower end thereof. Casing 32 includes; a bearing and sleeve retaining portion 38 adjacent the lower end thereof; an upper portion 40; and a radially outwardly expanded reservoir portion 42 located axially intermediate portions 38 and 40.

Upper portion 40 of casing 32 includes a circular opening 43 therethrough. Opening 43 has a stepped cylindrical peripheral surface and includes: a lower peripheral surface 44 having a diameter thereof substantially equal to the outer diameter of sleeve 34; an intermediate peripheral surface 46 having a diameter thereof less than the diameter of portion 44; and an upper piston rod bearing and sealing surface 48 having a diameter thereof less than the diameter of portion 46. A transversely extending sleeve seating surface 50 is formed at the juncture of surface 46 and 44. In final assembly of snubber 30, the uppermost end of sleeve 34 is firmly seated on seating surface 50.

Portion 38 of casing 32 includes a lower circular opening 52 therethrough. As shown, opening 52 is coaxially aligned with opening 43 and has a diameter thereof substantially equal to the outer diameter of closure and bearing member 37. The lower surface of member 37 has a downwardly extending convex configuration and the upper surface thereof includes a central circular depression 54 and an upwardly extending annular flange 56 thereon. The flange 56 is located intermediate the periphery of depression 54 and the outer periphery of member 37.

In final assembly member 37 is releasably and sealingly received within opening 52 in any suitable manner. As shown, the sealing relationship between member 37 and opening 52 is established by an O-ring 58 disposed in an outwardly extending peripheral groove in opening 52. The releasable retention of member 37 within opening 52 is shown as being accomplished by means of snap ring 60.

Prior to final assembly, sleeve 34 with piston assembly 36 therewithin is received within casing 32. The lowermost end of sleeve 34 is captively received by the annular flange 56 and the upper end thereof engages the annular sleeve seating surface 50.

At this point it is to be noted that one aspect to the invention herein is to provide a single snubber operating cartridge 33; which consists of piston assembly 36, closure and bearing member 37 and sleeve 34, which may be utilized with a family of snubber casings, for example casings 32, 32' and 32". This permits a significant savings insofar as manufacturing, inventory and testing regardless of the spring group position or orientation in which the snubber is to be utilized. Furthermore, maintenance and installation are greatly facilitated for the user need only be familiar with the operating parameters of a single operating cartridge. Accordingly it is to be understood that the primary distinctions between the snubbers 30' and 30" which will be described hereinafter from that of the snubber 30 is with respect to the configuration of the respective casings 32' and 32". Nevertheless in order to provide a true family of snubbers, the internal configurations of all of the casings 32, 32' and 32" must be substantially identical at the peripheral portions thereof adjacent the operating cartridge 33 for the selective receipt of cartridge 33 therewithin.

Piston assembly 36 comprises a piston head 62 and a cylindrical piston rod 64 suitably secured at the lower end thereof to piston head 62 and extending coaxially upwardly therefrom. Piston head 62 is provided with a central bore 66 therethrough which is in coaxial alignment with a central blind bore 68 in the piston rod 64. In final assembly a spring 70 is captively mounted in a compressed condition within the blind bore 68 and a plug 72 with a central bore 74 therethrough is threadably received within bore 66. A ball valve 76 is biased into seating engagement with bore 74 by spring 70. Assembly 36 additionally includes a ball valve seating member 78 disposed in bore 66 intermediate spring 70 and valve 76 to provide a seating and centering means for ball valve 76. The piston head 62 is provided with a plurality of circumferentially spaced bores 80 (only one being shown) which extend substantially vertically therethrough. A plurality of bores 82 (only one being shown) are also included within piston head 62 and extend diagonally from bore 74 to the upper surface of the piston head 62.

As shown in FIG. 4, an annular flapper or ring valve 84 covers the lower ends of bores 80 whenever pressure below the piston head 62 is substantially greater than pressure above the piston head 62. The valve 84 is free to move downwardly with respect to the bottom of piston head 62 a limited distance and is prevented from moving further in the axial direction by a flange extending radially outwardly from plug 72. Valve 84 includes an opening 85 therethrough which openly communicates with respective bores 80 in piston head 62. A compression and spring set 86, which may be considered an element of the operating cartridge 33, is disposed within the sleeve 34 intermediate the piston head 62 and the closure and bearing member 37 in a manner that the lower end thereof is captively received within the cylindrical depression 54 and the upper end thereof is captively received in a downwardly open annular groove 88 within piston head 62. Compression spring set 86 biases head 62 upwardly away from member 37.

As best seen in FIG. 4, piston head 62 divides the sleeve into upper and lower variable volume chambers 102 and 104, respectively. FIG. 4 illustrates the relative orientation of the components of the snubber operating cartridge of the snubbers 30, 30' and 30" when the piston assembly 36 is moving downwardly to decrease the volume of lower chamber 104 and also when the piston head 62 is in such a position to cooperate with the port orifice or valve means 106 to yield a relatively soft damping rate (i.e., 25 to 70 kip-seconds per foot) during the compression stroke of the piston assembly 36. The orientation of FIG. 4 would be the operational mode of the snubbers 30, 30' and 30" when the railway freight car is operating on smooth track with only small vertical motions of the spring group 22. Port valve means 106 are provided to vary the dampening rate of the snubbers 30, 30' and 30" and is position responsive (i.e., responsive to the axial position of the piston head 62 within the sleeve 34). Port valve means 106 comprises upper and lower vertically spaced ports or bores 108 and 110, respectively, which extend transversely through the wall of sleeve 34. Bores 108 and 110 respectively communicate between the upper and lower chambers 102 and 104 and with a formed or cast vertically extending groove 112 in the inner periphery of the snubber casing. For the best showing of the casing grooves and depressions reference is hereby made to FIGS. 10, 11 and 12 which is a detailed showing of the interior configuration of casing 32" of snubber 30". It is understood that the respective casings of snubbers 30 and 30' will have similar grooves and depressions therewithin which will cooperate with the operating cartridge 33 in a substantially identical manner as will be described hereinafter with respect to snubber 30".

Communication between the interior of the sleeve 34 and the reservoir 42" is proved by a circumferentially extending depression 118 and groove 120. Depression is formed within the interior wall of casing 32" downwardly adjacent the upper end of sleeve 34. Depression 118 communicates with chamber 102 adjacent the upper end thereof. Groove 120, which is also formed in the interior wall of casing 32" extends downwardly from depression 118 and thence laterally outwardly into communication with reservoir 42".

With an orientation and configuration as described above the primary interchange of hydraulic fluid (FIG. 4) from the lower chamber 104 to the upper chamber 102 and thence to the reservoir 42", when a snubber 30" is positioned in a railway truck 18 operating on smooth track with only small vertical motions of the spring group 14 is as follows:

1. Hydraulic fluid flows from the lower chamber 104 to the upper chamber 102 via openings 85 in ring valve 84 which communicate with the vertically extending piston bores 80.

2. When the snubber 30" is operating in the "soft" dampening mode, the piston head 62 is axially intermediate the bores 108 and 110 of port valve means 106. Thus, under these circumstances the primary flow of hydraulic fluid from the lower chamber 104 to the upper chamber 102, when the piston head 62 is moving downwardly, is from chamber 104, through bore 110, into groove 112 and therefrom through bore 108 and into the upper chamber 102.

3. In most instances of the "soft" dampening mode the pressure in the underside of the ball valve 76 will be insufficient to overcome the bias of the spring 70. Thus in the "soft" dampening mode fluid will not pass from chamber 104 to chamber 102 through bores 74 and 82.

4. The hydraulic fluid which is displaced from the upper chamber 102 by the rod 36 is discharged from chamber 102 to the reservoir 42" via the annular groove or depression 118 to the groove 120 and thence therefrom into the reservoir 42".

The arrangement described hereinabove with respect to port valve means 106 is also operative to yield a relatively higher or "hard" damping rate (i.e., 100 to 200 kip-seconds per foot) during the compression stroke of the piston assembly 36. This "hard" damping is preferred when the railway freight truck 18 is operating in instances of severe track roughness, at a resonant speed and/or at resonant speed on superelevated track. In these instances the tendency of tilting or swaying is at a maximum and, hence a relatively high damping rate is desirable to ensure maximum energy dissipation. In instances of "hard" damping during the compression stroke, the piston head 62 is circumferentially adjacent or below the lower bore 110 of port valve means 106. In this position there will be no interchange of hydraulic fluid from the lower chamber 104 to the upper chamber 102 through the bore 110-groove 112-bore 108 pathway. In this instance the interchange of hydraulic fluid will be through the opening 85-bore 80 flow path and also through the bore 74-bore 82 flow path. This latter flow path will become exposed when the pressure build-up in the lower chamber 104 overcomes the downwardly directed bias of the spring 70 and results in the ball valve 76 moving upwardly. It is to be noted that when operating on superelevated track or in instances of severe rocking both the upper and lower side snubbers will be operative in the "hard" damping mode. The lower side orientation will be essentially as described hereinabove and the upper side snubber orientation will result in the piston head 62 being adjacent or above the upper bore 108 of port valve means 106.

The flow path of the hydraulic fluid from the upper chamber 102 to the lower chamber 104 during the return or expansion stroke of the piston assembly 36 will be essentially as described in U.S. Pat. No. 3,837,292, assigned to the same assignee as is this invention, with the apparent slight behavioral modification caused by the inclusion of the port valve means 106 hereof. This modification will not be particularly significant because of the relatively free flow path which is presented through vertical bores 80 when the flapper valve 84 is in its down position.

A further point to be noted is that to achieve the abovementioned hydraulic fluid flows the upper and lower chambers 102 and 104 must be consistently maintained full of hydraulic fluid. This is accomplished by a pressurized charging of hydraulic fluid in conjunction with the maintenance of a requisite ullage volume in the reservoir 42", all as is fully explained in U.S. Pat. No. 3,837,292.

Thus it can be seen that by constructing a snubber which includes a port valve means 106 of the present invention a position responsive variable damping rate is achieved. Furthermore this variable damping rate is achieved with a very simplistic structure which: will not present a potential interference to the smooth reciprocation of the piston head 56; does not require the utilization of biasing means or the like; does not require the utilization of highly machined components (i.e., the vertical groove 112 may be within the casing casting and the bores 108 and 110 are simply drilled); and may be rapidly and relatively inexpensively altered. On this latter point if it were desired to vary the working parameters meters of the port valve means 106 it would merely be necessary to provide a new sleeve 34 which had differing vertically spaced upper and lower bores 108 and 110 therein. In the alternative screw-in plugs (not shown) could also be utilized which would close off a set of bores in favor of opening a differing set of bores through the sleeve 34 or which would decrease the diameter of the existing bores 108 and 110 and hence restrict the by-pass hydraulic fluid flow. This latter alternative would increase the "soft" damping rate. A still further feature to be noted is that the sleeve 34 as described herein is part of the standard or universal operating cartridge 33. Thus the utilization of the port valve means 106 of this invention still further increases the advantages of the "family of snubbers" concept of this invention which was mentioned hereinbefore and which will be discussed in more detail hereinafter.

At this point it is important to note that the invention herein additionally contemplates other arrangements of the port valve means 106 which will still achieve the requisite operational and structural parameters of the invention. For example: port valve means 106 may include a plurality of spaced bore-groove arrangements; if circumstances permit, the groove 112 may be formed in the outer peripheral wall of the sleeve 34 rather than the inner periphery of the snubber casing (In such situations, the thickness of the wall of sleeve 34 would be increased to compensate for the decreased section modulus in the vicinity of the groove 112. Illustratively the valve means 106 will appear substantially as shown in FIGS. 6 and 8; however, it is to be understood that in such an alternative arrangement, the vertical dotted slot will be in the exterior periphery of the sleeve 34 rather than the interior periphery of the casing); port valve means 106 with adjacent cooperating grooves in both the sleeve 34 and the snubber casing is contemplated; and the like.

Figure 2:
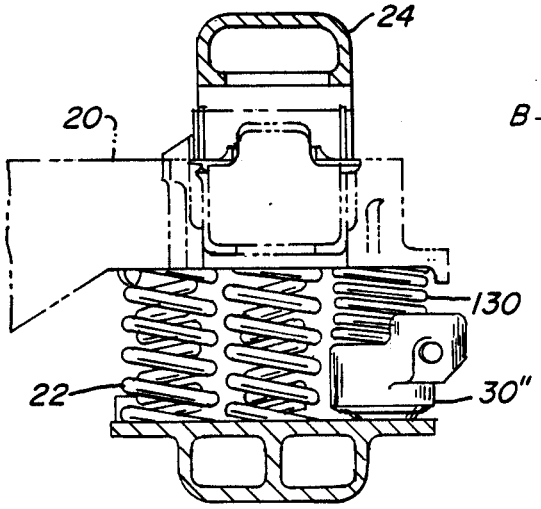
FIG. 2 is a fragmentary partially sectional and elevational view of the freight car truck illustrated in FIG. 1 and incorporating a snubber of this invention.
Figure 3:
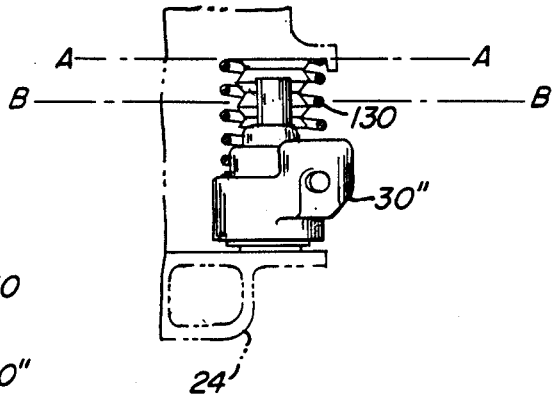
FIG. 3 is a view similar to FIG. 2 illustrating loaded and unloaded conditions of the freight car incorporating the snubber of this invention.

When the snubber 30, 30' or 30" is assembled with a body spring 130; for example as is described in U.S. Pat. Nos. 3,837,292, 3,772,995, 3,868,912 and 4,077,496, it extends between the side frame 24 and the bolster 20 as seen in FIGS. 1, 2 and 3. Also, as seen in FIG. 3, when the snubber is in position in an unloaded car the engaging surface of bolster 20 will be spaced upwardly of line A—A out of engagement with respect to the uppermost extent of piston rod 64. Hence, there will be very little or no action of the snubber 30, 30' or 30" even if the freight car truck 18 should bounce somewhat or rock slightly as it is being propelled along the tracks 28. The next horizontal line, namely B—B, represents the normal position of the engaging surface of bolster 20 with respect to the uppermost extent of piston rod 64 wherein piston rod 64 is in engagement with the engaging surface of bolster 20 adjacent thereto.

This operative spacing arrangement of the snubber 30, 30' and 30" has been first recognized in U.S. Pat. No. 3,837,292 and is at present generally recognized as the standard in the art for spring group snubber arrangements. However, as with any mechanical arrangements, certain problems have been recognized. Specifically, the body spring 130 which is utilized to maintain the snubber in its operating position has a tendency to cock or slip. This problem is not particularly germane to outer spring group locations; however, even so a concept was illustrated in U.S. Pat. No. 3,772,995 illustrating a lug retention structure directed to the body spring-snubber arrangement. Where this problem may be more significant is in the center spring group position of the snubber. In such a center position, any cocking, tilting or shifting of the body spring 130 or the snubber may result in deleterious operating and structural effects with respect to adjacent springs of: the spring group 22, the snubber itself, and/or adjacent portions of the freight car truck 18.

In recognition of the above problems the invention herein additionally teaches a configuration of the casing 32 of the snubber 30 which is to be positioned within the center of a spring group 22 and which may be used with or without a body spring 130. The illustration in FIG. 4 includes usage with a body spring 130; however, the showing in FIG. 13 illustrates the snubber 30 in position without a body spring 130. This latter embodiment is achieved by forming the circumferential reservoir portion 42 of casing 32 in a manner that circumferentially spaced sections of reservoir portion 42 will be in engagement with or closely adjacent to adjacent springs of the spring group 22. The adjacent springs will prevent any substantial lateral movement of snubber 30 with respect to the bearing surface of the side frame 24. As illustrated casing 32 has an outer peripheral configuration of reservoir portion 42 such that the inner and outer sides 132 and 134 thereof (as viewed along the longitudinal axis of the side frame 24) have a generally concave configuration and the transversely spaced sides 136 extend in a direction generally parallel to the longitudinal axis of the side frame 24. The corners 138 of reservoir portion 42 extend on a diagonal between sides 132 and 134 and the respective ends of sides 136 adjacent thereto. Thus the configuration of reservoir portion 42 provides a snubber 32 which, when positioned within a spring group 22 will be laterally in engagement with or at least closely adjacent six springs of the spring group 22. Specifically, sides 132 and 134 will be in engagement with or closely adjacent respective longitudinally adjacent springs of spring group 22 and the four diagonal corners 138 will be in engagement with or closely adjacent diagonally adjacent springs of the spring group 22. It is to be further noted that the radius of curvature of the concave sides 132 and 134 are greater than the radius of the supporting springs adjacent thereto and that, if desired, the primary retention of the snubber 32 within the spring group 22 may be merely by having sides 132 and 134 at least closely adjacent the adjacent springs of spring group 22.

As best illustrated in FIG. 4, casting 32 additionally includes a heat dissipation means 140 adjacent the upper end thereof. Heat dissipation means 140 may be of any suitable type and, as shown, comprises a single radially outwardly extending fin arrangement which is located adjacent the opening 43 of upper casing portion 40 and which is integrally formed with casing 32 when casing 32 is cast. The heat dissipation means is necessary because an excessive heat build-up may occur adjacent opening 43 with the resultant deleterious effects of potential seal problems and inefficiencies. This heat build-up problem is of particular significance when a snubber is positioned in the center of a spring group 22 because of lack of adequate cooling air flow thereat. However, it is to be noted that the heat dissipation means 140 may additionally be used with snubbers at other spring group locations, if desired.

As was mentioned hereinbefore and as is amply illustrated in FIGS. 13, 14 and 15, the invention herein teaches a "family of snubbers" concept which utilizes a single operating cartridge 33 with a plurality of snubber casings 32, 32' and 32" for use in virtually any spring group location or with any normal type spring group arrangement. The snubber casing configuration may be varied substantially within environmental limitations with the only other common requirement being that the interior configurations be such that they will accept the operating cartridge 33.

The invention described herein is to the presently preferred embodiments. Accordingly, it is understood that various modifications may be made by those knowledgeable in the art to the preferred embodiments discussed hereinabove without departing from the scope of the invention which is defined by the claims set forth hereinafter. For example: structural and operational alterations may be made to the operating cartridge 33 so long as such alterations consider the universal usage of the cartridge 33; the "family of snubbers" concept of this invention will be equally operable with a cartridge assembly 33 which does not include a variable dampening rate such as is provided by port valve means 106 or which includes another type of a variable dampening means; other casing configurations may be utilized as conditions dictate to provide an even larger "family of snubbers" and the like.

I claim:

1. In a railway truck assembly having a spring group consisting of a plurality of elongated springs disposed vertically between opposed horizontally extending surfaces of an upper bolster member and a lower portion of a side frame member to resiliently support said bolster member with respect to said side frame member as said springs compress and extend along laterally spaced, vertically extending axes, respectively, in response to relative vertical movement between said opposed horizontally extending surfaces, and wherein peripheral surface portions of said springs define an open area generally centrally within said spring group, the improvement comprising:

a hydraulic snubber disposed within said open area in a vertical operational position, said snubber including a casing supported by said horizontally extending surface on said side frame member and a piston having a head portion received within said casing and a rod portion extending externally of said casing, said rod portion having an outer end portion which is spaced from said horizontally extending surface of said bolster member when said springs are extended, said piston being reciprocable along a vertically extending axis of said snubber, said casing having an integral portion with an outer periphery thereof located radially outward of said vertically extending axis of said snubber and having a plurality of circumferentially extending, generally concave surfaces located closely adjacent said peripheral surface portions of a respective plurality of springs in said spring group and being cooperable therewith to permit limited lateral movement of said snubber within said open area while maintaining said snubber in said vertical operational position within said spring group.

2. The improvement as specified in claim 1 wherein said plurality of circumferentially extending surfaces includes at least a pair of opposed, similar surfaces.

3. The improvement as set forth in claim 2 wherein the cooperation of said circumferentially extending surfaces with said peripheral surface portions constitutes the sole lateral support of said casing within said open area when said springs are extended.

4. The improvement as specified in claim 4 wherein said outer end portion of said rod portion is intermittently engageable with said horizontally extending surface of said bolster member as said springs are compressed and re-extended, and said cooperation of said circumferentially extending surfaces is effective to maintain said snubber in said vertical operational position when said outer end portion of said rod portion is engaged with or disengaged from said horizontally extending surface of said bolster member.

5. A hydraulic snubber adapted to be disposed within the center position of a spring group including a plurality of elongated springs which extend vertically intermediate a bolster member and a side frame member of a railway truck comprising:

a casing adapted to be supported by such a side frame member;

a piston having a head portion received within said casing and a rod portion which partially extends externally of said casing; and said casing having an integral portion with an outer periphery thereof located radially outward of the axis of said piston and having a plurality of circumferentially extending surfaces adapted to cooperate with selected springs of such a spring group to permit limited lateral movement of said snubber within such a center position while maintaining said snubber in the operative position thereof within such a spring group.

6. The snubber as specified in claim 5 wherein said piston rod portion is alternately engageable with an disengageable from such a bolster and said circumferentially extending surfaces are adapted to cooperate with said selected springs of such a spring group to provide the sole lateral support for maintaining said snubber in the operative position thereof when said rod portion is disengaged from such a bolster.

* * * * *

UNITED STATES PATENT AND TRADEMARK OFFICE

CERTIFICATE OF CORRECTION

PATENT NO. : 4,936,226

DATED : June 26, 1990

INVENTOR(S) : Donald Wiebe

It is certified that error appears in the above—identified patent and that said Letters Patent is hereby corrected as shown below:

In column 11, claim 4, line 1, "claim 4" is deleted and is replaced by --claim 1--.

In column 12, claim 6, line 2, "an" is deleted and is replaced by --and--.

Signed and Sealed this

Twenty-fourth Day of September, 1991

*Attest:*

HARRY F. MANBECK, JR.

*Attesting Officer*

*Commissioner of Patents and Trademarks*